US005652950A

United States Patent [19]

Kim

[11] Patent Number: 5,652,950

[45] Date of Patent: Jul. 29, 1997

[54] POWER SAVING METHOD IN IMAGE FORMING APPARATUS USING ELECTROPHOTOGRAPHIC DEVELOPING METHOD

[75] Inventor: Young-Ju Kim, Suwon, Rep. of Korea

[73] Assignee: SamSung Electronics Co., Ltd., Suwon, Rep. of Korea

[21] Appl. No.: 645,454

[22] Filed: May 13, 1996

[30] Foreign Application Priority Data

May 18, 1995 [KR] Rep. of Korea ..... 12473/1995

[51] Int. Cl.[6] ..... G03G 15/20

[52] U.S. Cl. ..... 399/70; 219/492; 364/707; 395/750

[58] Field of Search ..... 355/208, 206, 355/205, 282, 285; 219/216, 492; 364/492, 707; 395/750; 399/70

[56] References Cited

U.S. PATENT DOCUMENTS

| | | | |
|---|---|---|---|
| 4,113,375 | 9/1978 | Murata et al. | 355/285 |
| 4,627,714 | 12/1986 | Nozaki | 355/285 |
| 4,642,448 | 2/1987 | Shigemura et al. | 219/216 |
| 4,745,436 | 5/1988 | Matsuura | 355/206 |
| 4,870,526 | 9/1989 | Maruta et al. | 355/206 X |
| 4,922,296 | 5/1990 | Kasuya et al. | 355/208 |
| 4,980,836 | 12/1990 | Carter et al. | 364/483 |
| 4,994,852 | 2/1991 | Matsuuchi et al. | 355/206 |
| 5,002,266 | 3/1991 | Kikuchi et al. | 271/3.2 |
| 5,016,052 | 5/1991 | Sambayashi et al. | 355/228 |
| 5,019,693 | 5/1991 | Tamary | 219/216 |
| 5,087,941 | 2/1992 | Smith | 355/208 X |
| 5,108,204 | 4/1992 | Suemune et al. | 400/54 |
| 5,241,349 | 8/1993 | Nagasaka | 355/285 |
| 5,293,196 | 3/1994 | Kaneko et al. | 355/200 |
| 5,321,428 | 6/1994 | Dornier | 347/211 |
| 5,321,478 | 6/1994 | Nakamura et al. | 355/285 |
| 5,321,479 | 6/1994 | Yoshida et al. | 355/285 |
| 5,457,516 | 10/1995 | Kim | 355/208 |
| 5,475,847 | 12/1995 | Ikeda | 395/750 |
| 5,483,464 | 1/1996 | Song | 364/492 |
| 5,550,637 | 8/1996 | Murakami | 219/216 X |

*Primary Examiner*—Arthur T. Grimley
*Assistant Examiner*—Sophia S. Chen
*Attorney, Agent, or Firm*—Robert E. Bushnell, Esq.

[57] ABSTRACT

A power saving method of an image forming apparatus using an electrophotographic developing unit includes the steps of: beginning a counting operation upon occurrence of an error state in the image forming apparatus, when the image forming apparatus is in a print stand-by mode; determining whether a current counting value reaches a reference comparison value for executing a power saving mode; determining whether the error state is removed from the image forming apparatus, when the current counting value has not reached the reference comparison value; increasing the currently counting value by a given counting unit and returning to determine whether the current counting value reaches the reference comparison value, when the error state has not been removed from the image forming apparatus; and executing the power saving mode of driving the image forming apparatus with electric power lower than electric power required for maintaining said image forming apparatus in the print stand-by mode, when the present counting value reaches the reference comparison value.

20 Claims, 2 Drawing Sheets

POWER SAVING METHOD IN IMAGE FORMING APPARATUS USING ELECTROPHOTOGRAPHIC DEVELOPING METHOD

CROSS-REFERENCE TO RELATED APPLICATION

This application makes reference to, incorporates the same herein, and claims all benefits accruing under 35 U.S.C. §119 from an application for Power Saving Method In Image Forming Apparatus Using Electrophotographic Developing Method earlier filed in the Korean Industrial Property Office on 18 May 1995, and there duly assigned Ser. No. 12473/1995.

BACKGROUND OF THE INVENTION

Technical Field

The present invention relates to a power saving method of an image forming apparatus such as a laser printer, and more particularly to a power saving method of an image forming apparatus which automatically deactivates operation of an engine unit in dependence upon occurrence of one of an expiration of a given time period during a stand-by mode, and generation of an operational error in an image forming apparatus for reducing power consumption.

Background Art

Generally, an image forming apparatus using an electrophotographic developing unit such as, for example, a copier, a laser beam printer is becoming highly popular because of its high image quality, high speed printing, multiple copy capability and low noise. Maintenance costs due to power consumption are, however, burdensome. Traditionally, the image forming apparatus is required to maintain the temperature of a fixing unit at a printable temperature at all time. Consequently, electric power is always supplied to the fixing unit and, when the image forming apparatus is not being used, is wasted.

To avoid this problem, an image forming apparatus such as disclosed, for example, in U.S. Pat. No. 4,618,245 for Image Forming Apparatus And Attachment Which Together Enter An Energy Saving Mode issued to Fukushi et at., is provided with a print stand-by mode in which the temperature of the fixing unit is kept lower than a printable temperature in order to reduce power consumption. Other examples are disclosed in U.S. Pat. No. 4,878,092 for Method Of Controlling A Fixing Unit Of An Image Forming Apparatus issued to Arai, in which the fixing unit is set at two different printable temperatures, and in U.S. Pat. No. 5,241,349 for Image Forming Apparatus Having A Plurality Of Control Modes Of Thermal Fixing Apparatus issued to Nagasaka, in which the fixing unit is automatically set at three different temperatures based on whether such an image forming apparatus is in use. In Nagasaka '349 for example, a controller is provided to raise a temperature of the fixing unit to a printable temperature while the image forming apparatus is in use and to a stand-by temperature while the image forming apparatus is in a stand-by mode. When the image forming apparatus is not in use for a predetermined period however, no electric power is applied to the fixing unit in order to reduce power consumption.

Other power saving techniques for such an image forming apparatus recently available are disclosed, for example, in U.S. Pat. No. 5,483,464 for Power Saving Apparatus For Use In Peripheral Equipment Of A Computer issued to Song, U.S. patent application Ser. No. 08/366,599 for A Power Saving Printing Method Of A Printing System fled on 30 Dec. 1994 by the same assignee, Samsung Electronics Ltd., U.S. patent application Ser. No.08/358,174 for A Power Saving Apparatus For Use In An Image Forming System filed on 16 Dec. 1994 by the same assignee, Samsung Electronics Ltd., and Korean Application No. 93-31415 also assigned to the same assignee all of which the problem relating to power consumption is addressed. It has been my observation however that these power consumption techniques fail to address the unnecessary power consumption when the image forming apparatus experiences a malfunction or an operational error such as a paper jam, a line error or a paper empty state etc.

While there are conventional techniques such as disclosed, for example, in U.S. Pat. No. 4,994,852 for Image Forming Apparatus Having A Malfunction Detection Device And Power Shutdown Therefor issued to Matsuuchi et at., U.S. Pat. No. 5,108,204 for Protective Circuit For A Printer Driver issued to Suemune et at., U.S. Pat. No. 5,293,196 for Communication Control Apparatus For Monitoring A Condition For A Machine And For Transmitting The Condition To An External Apparatus issued to Kaneko et al., in which a malfunction relating to the fixing unit is relied upon as a basis to shut down the power supply to the image forming apparatus, these power shutdown techniques however fail to provide an effective means for the image forming apparatus to reduce power consumption. Moreover, malfunction detection such as disclosed in Matsuuchi et al. '852 is limited to a fixing unit of the image forming apparatus. Further, once the image forming apparatus is shut down, recovery to previous function can not be established.

SUMMARY OF THE INVENTION

Accordingly, it is therefore an object of the present invention to provide a power saving method for an image forming apparatus.

It is another object to provide a power saving method for an image forming apparatus which reduces power consumption.

It is still another object to provide a power saving method for an image forming apparatus which automatically deactivates operation of an engine unit in dependence upon occurrence of one of an expiration of a given time period during a stand-by mode, and generation of an operational error in an image forming apparatus.

These and other objects of the present invention can be achieved by a power saving method for an image forming apparatus using an electrophotographic developing unit constructed to perform the steps of: beginning a counting operation upon occurrence of an error state in the image forming apparatus, when the image forming apparatus is in a print stand-by mode; determining whether a current counting value reaches a reference comparison value for executing a power saving mode; determining whether the error state is removed from the image forming apparatus, when the current counting value has not reached the reference comparison value; increasing the currently counting value by a given counting unit and returning to determine whether the current counting value reaches the reference comparison value, when the error state has not been removed from the image forming apparatus; and executing the power saving mode of driving said image forming apparatus with electric power lower than electric power required for maintaining said image forming apparatus in the print stand-by mode, when the present counting value reaches the reference comparison value.

The power saving method for an image forming apparatus of a second embodiment requires the steps of: starting a counting operation upon initialization of the image forming apparatus in a stand-by mode; determining whether a current counting value reaches a reference comparison value for executing a power saving mode; determining whether there is a malfunction in the image forming apparatus, when the current counting value has not reached the reference comparison value; determining whether a print command has been entered by an operator, when there is no malfunction in said image forming apparatus; increasing the current counting value by a given counting unit and returning to determine whether the current counting value reaches the reference counting value, when there is a malfunction in the image forming apparatus, and alternatively when the print command has been entered by the operator; executing the power saving mode for driving the image forming apparatus with power lower than the power required to maintain said image forming apparatus in the stand-by mode, when the current counting value reaches the reference comparison value; and performing a print operation in response to the print command.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

The preferred embodiment of the present invention is described hereinafter with reference to the accompanying drawings. In the following description, numerous specific details are set forth in order to provide a thorough understanding of the present invention. It will be apparent, however, to one skilled in the art, that the present invention may be practiced without these specific details. In other instances, well known circuits will not be described so as to not obscure the present invention.

Figure 1:
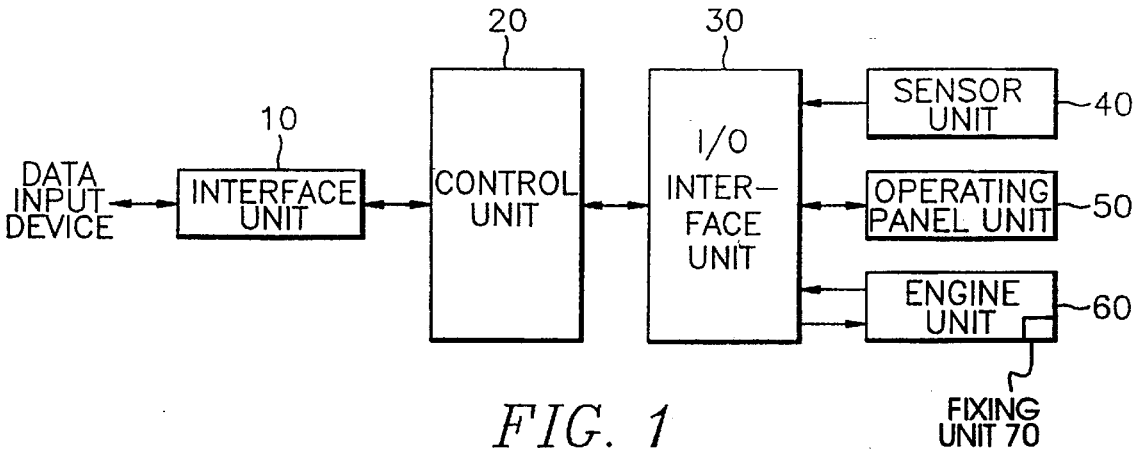
FIG. 1 is a block diagram illustrating the structure of a general printer using an electrophotographic developing method.

FIG. 1 illustrates a general construction of an image forming apparatus using an electrophotographic developing system. The image forming apparatus of FIG. 1 includes an interface unit 10 connected to an external data input device such as a host computer (not shown), for receiving image data from the external data input device. A control unit 20 communicates with the data input device through the interface unit 10 in order to control an engine unit 60 for performing an image forming operation according to various commands input from the external data input device and an operating panel unit 50.

An input/output (I/O) interface unit 30 is connected between the control unit 20, a sensor unit 40, the operating panel unit 50 and the engine unit 60 in order to facilitate signal transmission between the control unit 20 and other operational components of the image forming apparatus. The sensor unit 40 drives individual sensors for sensing an operational state of each components of the image forming apparatus, including any malfunction or an operational error such as a transmission line error, a paper empty state, an engine drive error, a paper jam and a toner empty state etc . . . and applies an output signal of each sensor to the control unit 20 through the I/O interface 30. The operating panel unit 50 includes a display device for providing a visual display of information in accordance with command keys input by a user and operations of the image forming apparatus. The engine unit 60 includes a fixing unit 70 comprised of a heat lamp (not shown) and driving mechanisms (not shown) for conveying individual sheet of recording paper and for performing a print operation under the control of the control unit 20.

Figure 3:
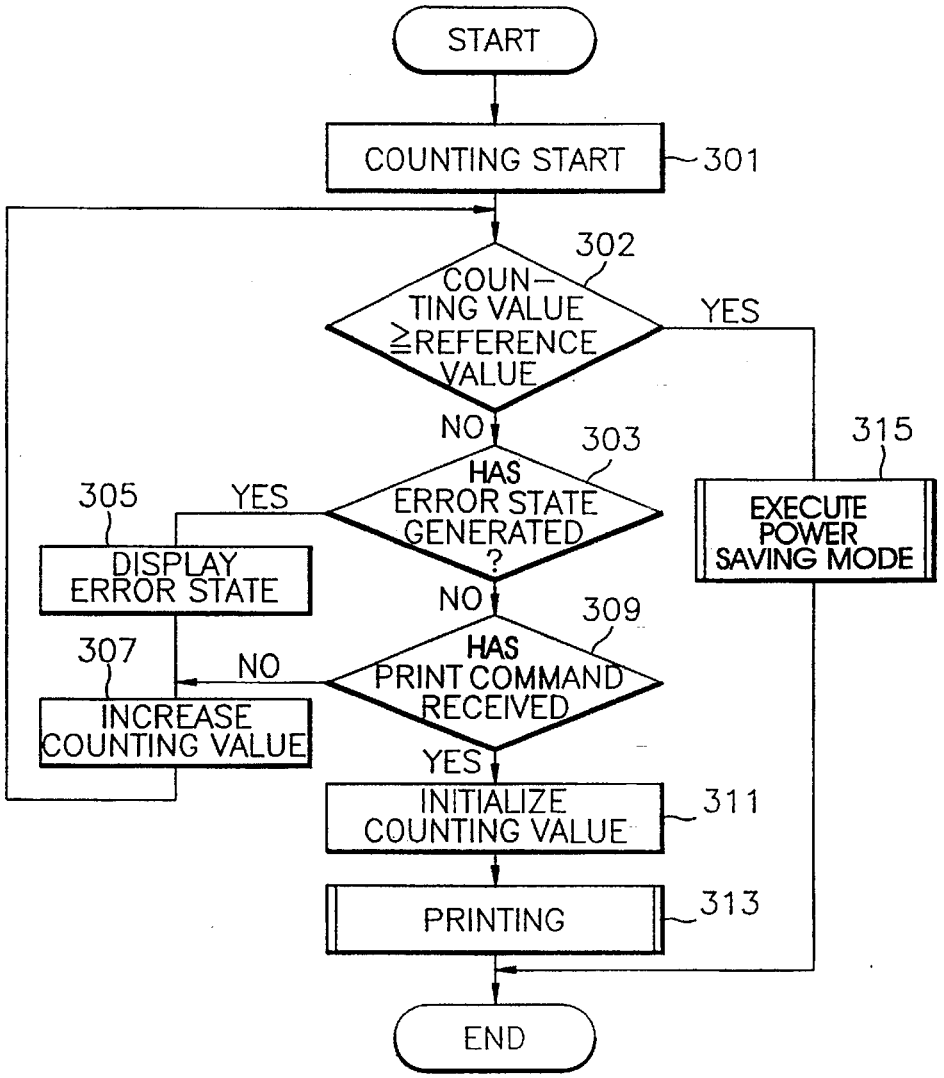
FIG. 3 is a flow chart illustrating a power saving operation in accordance with another embodiment of the present invention.
Figure 2:
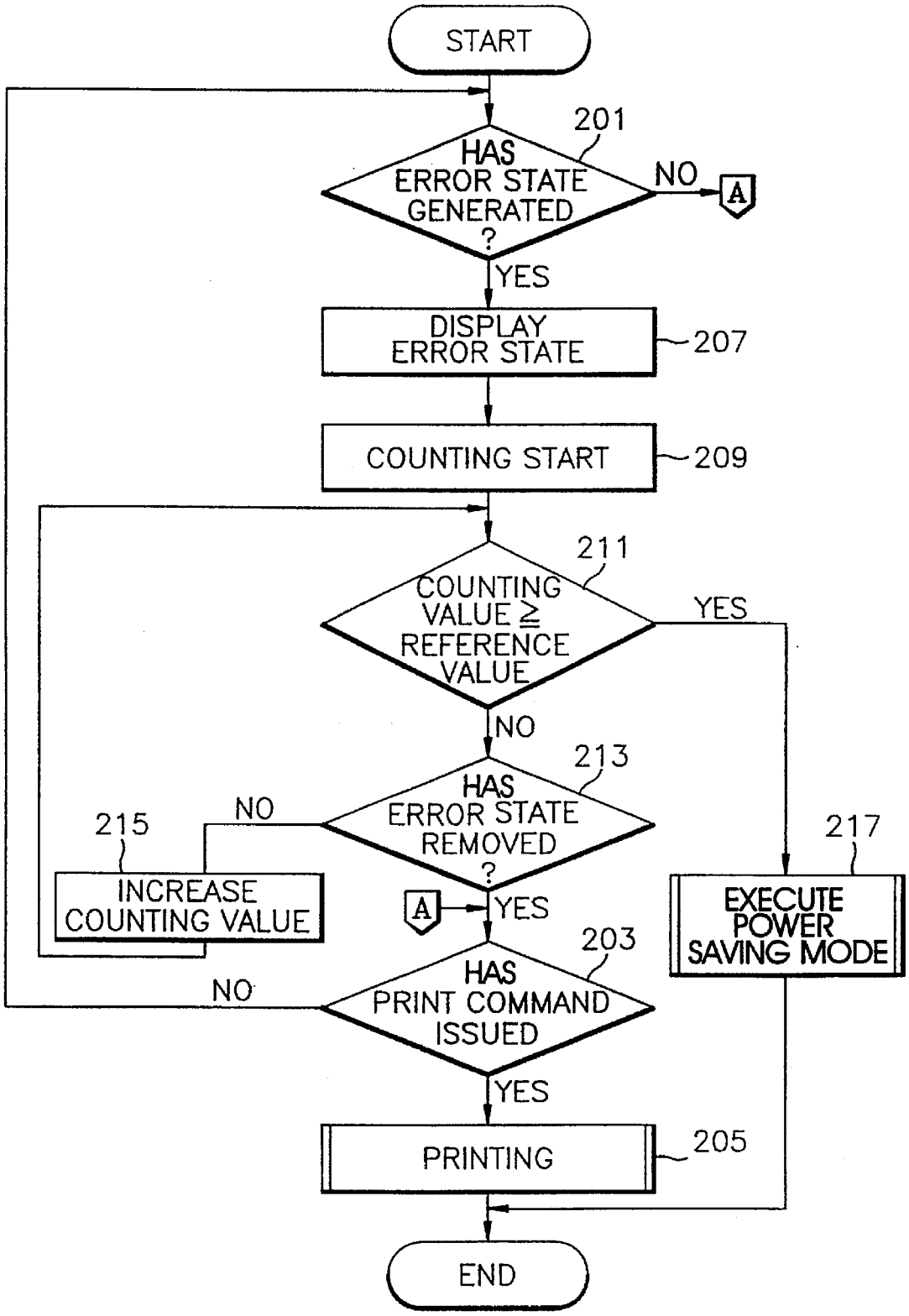
FIG. 2 is a flow chart illustrating a power saving operation in accordance with a preferred embodiment of the present invention.

Turning now to FIG. 2 which illustrates a power saving operation in accordance with one preferred embodiment of the present invention, and to FIG. 3 which illustrates a power saving operation in accordance with another embodiment of the present invention.

With reference to FIG. 2, the preferred embodiment of the present invention is described as follows. First, the control unit 20 controls the engine unit 60 to raise an internal temperature of a fixing unit of the engine unit 60 to a print stand-by temperature and maintaining the print stand-by state. After the temperature of the fixing unit of the engine unit 60 reaches the stand-by temperature, the control unit 20 determines whether an error state is generated through the interface unit 10 and the sensor unit 40 at step 201. That is, in step 201, the control unit 20 detects an error state of the image forming apparatus such as a transmission line error, a paper empty state, an engine drive error, a paper jam or a developing material empty state, etc. If there is no error state detected at step 201, the control unit 20 determines whether a print command has been entered by an operator and received through the transmission line and the interface unit 10 at step 203. At this time, if the print command is received through the transmission line and the interface unit 10 at step 203, the control unit 20 controls the engine unit 60 to perform a print operation at step 205.

If, on the other hand, an error state is generated through the interface unit 10 at step 201, the control unit 20 displays the corresponding error state through the operating panel unit 50 at step 207. That is, if for example a current amount of developing material is less than a reference value, the "toner empty" state is displayed through the display unit. When an error state is displayed on the display unit of an operating panel unit 50, the control unit 20 initializes the counting value at step 209 to start the counting operation in order to proceed to the power saving mode. Once the counting operation is started, the control unit 20 compares the counting value with a reference count value in order to determine a starting time of the power saving mode at step 211. At this time, if the counting value reaches the reference count value, the control unit 20 executes the power saving mode at step 217 and terminates the power saving operation. If the counting value is less than the reference count value, however, the control unit 20 determines whether the error state has been removed from the image forming apparatus at step 213, that is, the control unit 20 determines that an error state removing operation such as a paper feeding operation, a developing material refilling operation and a paper jam removing operation or an engine error removing operation, etc., has been performed to correct the error. Once the control unit 20 determines that such an error state has been removed from the image forming apparatus at step 213, the control unit 20 proceeds to step 203 and determines whether a printing command has been issued by an operator at step 205 in order to perform a print operation.

If, on the other hand, the control unit 20 determines that the error state has not been removed from the image forming apparatus at step 213, the control unit 20 increases the current counting value by a given count unit at step 215, and at step 211, compares the current counting value with the reference count value again. That is, through the steps mentioned above, the control unit 20 determines the time lapsed after the error state is generated. Accordingly, when the current counting value is determined as being equal or greater than the reference count value at step 211, the control unit 20 executes the power saving mode at step 217.

In the preferred embodiment of the present invention as described above, if an error state of the image forming apparatus using the electrophotographic developing system is continued beyond a given period of time, the power saving mode is executed in order to reduce power consumption.

The power saving mode may be executed through various controlling steps for reducing power consumption of image forming apparatus, such as the step of maintaining the heating state of a heat lamp by the given temperature or the step of stopping power supply to various engine constructing units. In one embodiment of the present invention, the power saving mode is executed through all the controlling steps of the image forming apparatus with reduced power consumption than the power required for the image forming apparatus to maintain in the print stand-by state and the error state.

With reference to FIG. 3 which illustrates a power saving operation in accordance with a second embodiment of the present invention. First, the control unit 20 controls the engine unit 60 to raise an internal temperature of a fixing unit of the engine unit 60 to the temperature of a print stand-by state and maintaining the print stand-by state. After the temperature of the engine unit 60 reaches the stand-by temperature, the control unit 20 starts the counting operation for proceeding to the power saving mode at step 301, and at step 302, compares the counting value with a reference count value in order to determine a starting time of the power saving mode. At this time, if the counting value reaches the reference count value at step 302, the control unit 20 executes the power saving mode at step 315 and terminates the power saving operation. If the counting value is less than the reference count value, however, the control unit 20 determines whether an error state is generated through the interface unit 10 and sensor unit 40 at step 303. That is, in step 303, the control unit 20 determines the error state such as an transmission line error, a paper empty state, an engine drive error, a paper jam or a developing material empty state, etc. When an error state is not generated, at step 303, the control unit 20 determines whether a print command has been entered by an operator and is received through the transmission line and the interface unit 10. At this time, if the print command is received at step 309, the control unit 20 initializes the counting value at step 311, and controls the engine unit 60 in order to perform a print operation at step 313. If, on the other hand, the print command is not received at step 309, the control unit 20 increases the counting value by a given count unit at step 307, and then returns back to step 302. Further, if the error state is generated at step 303, the control unit 20 displays the corresponding error state through the operating panel unit 50 at step 305. The control unit 20 then increases the counting value by the given count unit at step 307 and then returns back to step 302. As contemplated by the present invention, the counting operation is used to initiate the power saving mode when the current counting value reaches a reference count value.

Briefly, in the second embodiment of the present invention, if the print operation of the image forming apparatus using the electrophotographic developing system is not performed beyond the given period of time, the power saving mode is executed regardless of the generation of an error state in order to reduce power consumption.

In the image forming apparatus using the electrophotographic developing system as described previously, the power saving mode is executed by counting the print stand-by time and the error state maintenance time. Accordingly, the present invention has an advantage in that power consumption can be reduced even upon the generation of an error state.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A power saving method of in image forming apparatus using an electrophotographic developing unit, said method comprising the steps of:

beginning a counting operation upon occurrence of an error state in said image forming apparatus, when said image forming apparatus is in a print stand-by mode;

determining whether a current counting value of said counting operation reaches a reference comparison value for executing a power saving mode; and executing said power saving mode of driving said image forming apparatus with electric power lower than electric power required for maintaining said image forming apparatus in the print stand-by mode, when the present counting value reaches said reference comparison value.

2. The power saving method of claim 1, further comprising the steps of:

determining whether the error state occurred in said image forming apparatus has been removed from said image forming apparatus, when the current counting value has not reached said reference comparison value; and increasing the current counting value of said counting operation by a given counting unit and returning to determining whether the current counting value of said counting operation reaches said reference comparison value for executing said power saving mode, when the error state has not been removed from said image forming apparatus.

3. The power saving method of claim 2, further comprised of determining whether a print command has been entered by an operator for performing a print operation, when there is no occurrence of the error state in said image forming apparatus, while said image forming apparatus is in said print stand-by mode.

4. The power saving method of claim 3, further comprised of displaying the error state on an operating panel alerting an operator that the image forming apparatus experiences one of a transmission line error, a paper empty state, an engine drive error, a paper jam and a toner empty state, upon occurrence of the error state in said image forming apparatus.

5. The power saving method of claim 4, further comprising the steps of:

determining whether a prim command is entered by the operator, when said error state has been removed from said image forming apparatus;

performing a prim operation in response to reception of said print command; and alternatively, maintaining said image forming apparatus in the print stand-by state when said print command has not been entered by the operator.

6. The power saving method of claim 1, further comprised of displaying the error state on an operating panel alerting an operator that the image forming apparatus experiences one of a transmission line error, a paper empty state, an engine drive error, a paper jam and a toner empty state, upon occurrence of the error state in said image forming apparatus.

7. The power saving method of claim 1, further comprising the steps of:

determining whether a print command is entered by an operator, when said error state has been removed from said image forming apparatus;

performing a prim operation in response to reception of said print command; and alternatively, maintaining said image forming apparatus in the print stand-by state when said print command has not been entered by the operator.

8. The power saving method of claim 1, further comprised of said error state representing one of a transmitting line error, a paper empty state, an engine drive error, a paper jam and a toner empty state.

9. A power saving method of an image forming apparatus using an electrophotographic developing unit, said power saving method comprising the steps of:

(a) starting a counting operation upon initialization of said image forming apparatus in a stand-by mode;

(b) determining whether a current counting value satisfies a reference comparison value for executing a power saving mode;

(c) determining whether there is a malfunction in said image forming apparatus, when the current counting value does not satisfy said reference comparison value;

(d) determining whether a print command is entered by an operator, when there is no malfunction in said image forming apparatus;

(e) increasing the current counting value by a given counting unit and proceeding to step (b), when there is a malfunction in said image forming apparatus, and alternatively when the print command has been entered by the operator;

(f) executing said power saving mode for driving said image forming apparatus with power lower than the power required to maintain said image forming apparatus in the stand-by mode, when the current counting value satisfies said reference comparison value; and (g) performing a print operation in response to the print command.

10. The power saving method of claim 9, wherein said reference comparison value is satisfied when the current counting value is not less than said reference comparison value.

11. The power saving method of claim 9, further comprised of displaying the error state on an operating panel alerting the operator that the image forming apparatus experiences one of a transmission line error, a paper empty state, an engine drive error, a paper jam and a toner empty state, upon occurrence of the error state in said image forming apparatus.

12. The power saving method of claim 9, further comprised of re-initializing said counting operation each time the print command has been entered by the operator for performing said print operation.

13. An image forming apparatus, comprising:

a fixing unit for fixing a toner image on an individual sheet of recording paper;

malfunction detector means for generating a malfunction signal indicating a malfunction in said image forming apparatus;

means for electrically heating said fixing unit to a first temperature for fixing the toner image on the individual sheet of recording paper, to a second temperature lower than said first temperature when said image forming apparatus is in a stand-by mode, and to a third temperature lower than said second temperature when said image forming apparatus is in a power saving mode;

control means for controlling operation of said image forming apparatus and reducing power consumption by:

heating the fixing unit to said first temperature upon initialization of said image forming apparatus for preparation of fixing the toner image on the individual sheet of recording paper;

executing said stand-by mode of said image forming apparatus to reduce the temperature of the fixing unit from said first temperature to said second temperature, after completion of fixing the toner image on the individual sheet of recording paper for a predetermined time period;

beginning a counting operation upon occurrence of said malfunction in said image forming apparatus, when said image forming apparatus is in said stand-by mode;

determining whether a current counting value of said counting operation reaches a reference comparison value for executing said power saving mode; and executing said power saving mode of said image forming apparatus to reduce the temperature of said heating unit from said second temperature to said third temperature, when the present counting value reaches said reference comparison value.

14. The image forming apparatus of claim 13, further comprised of said control means determining whether said malfunction has been removed from said image forming apparatus, when the current counting value has not reached said reference comparison value; and increasing the current counting value of said counting operation by a given counting unit and returning to determine whether the current counting value reaches the reference comparison value, when said malfunction has not been removed from said image forming apparatus.

15. The image forming apparatus of claim 14, further comprised of said control means determining whether a print command has been entered by an operator for performing a print operation, when there is no occurrence of said malfunction while said image forming apparatus is in said print stand-by mode.

16. The image forming apparatus of claim 15, further comprising means for providing a visual display of said malfunction alerting the operator that the image forming apparatus experiences one of a transmission line error, a paper empty state, an engine drive error, a paper jam and a toner empty state; upon occurrence of the error state in said image forming apparatus.

17. The power saving method of claim 16, further comprised of said control means further:

determining whether a print command is entered by the operator, when said malfunction has been removed from said image forming apparatus;

performing a print operation in response to reception of said print command; and alternatively, maintaining said image forming apparatus in the print stand-by mode when said print command has not been entered by the operator.

18. The image forming apparatus of claim 14, further comprising means for providing a visual display of said malfunction alerting an operator that the image forming apparatus experiences one of a transmission line error, a paper empty state, an engine drive error, a paper jam and a toner empty state, upon occurrence of the error state in said image forming apparatus.

19. The image forming apparatus of claim 13, further comprised of said control means determining whether a print command has been entered by an operator for performing a print operation, when there is no occurrence of said malfunction while said image forming apparatus is in said print stand-by mode.

20. The power saving method of claim 13, further comprised of said control means further:

determining whether a print command is entered by an operator, when said malfunction has been removed from said image forming apparatus;

performing a print operation in response to reception of said print command; and alternatively, maintaining said image forming apparatus in the print stand-by mode when said print command has not been entered by the operator.

* * * * *